US009812832B2

(12) United States Patent
Su et al.

(10) Patent No.: US 9,812,832 B2
(45) Date of Patent: Nov. 7, 2017

(54) CONNECTOR HOLDER AND ELECTRONIC DEVICE WITH CONNECTOR HOLDER

(71) Applicant: WISTRON CORPORATION, New Taipei (TW)

(72) Inventors: Chia-Cheng Su, New Taipei (TW); Tsung-Hsien Chen, New Taipei (TW); Ping-Feng Liao, New Taipei (TW); Tsung-Jen Su, New Taipei (TW); Chih-Nan Peng, New Taipei (TW)

(73) Assignee: Wistron Corporation, New Taipei (TW)

( * ) Notice: Subject to any disclaimer, the term of this patent is extended or adjusted under 35 U.S.C. 154(b) by 0 days.

(21) Appl. No.: 15/013,506

(22) Filed: Feb. 2, 2016

(65) Prior Publication Data

US 2017/0063010 A1 Mar. 2, 2017

(30) Foreign Application Priority Data

Aug. 25, 2015 (TW) ..... 104127771 A

(51) Int. Cl.
*H01R 12/00* (2006.01)
*H01R 27/02* (2006.01)
*H01R 13/52* (2006.01)

(52) U.S. Cl.
CPC ..... *H01R 27/02* (2013.01); *H01R 13/5213* (2013.01)

(58) Field of Classification Search
CPC ... H01R 13/6658; H01R 27/00; H01R 13/518
USPC ..... 439/76.1, 218, 540.1
See application file for complete search history.

(56) References Cited

U.S. PATENT DOCUMENTS 6,851,955 B2 * 2/2005 Chen ..... H01R 31/065 439/76.1
7,200,702 B2 4/2007 Keely et al.
7,648,372 B2 * 1/2010 Wu ..... H01R 13/516 439/41
7,946,859 B1 * 5/2011 Tseng ..... H05K 5/0026 439/676
8,342,861 B2 * 1/2013 Stiehl ..... H01R 24/30 439/695

(Continued)

FOREIGN PATENT DOCUMENTS

CN 104127771 11/2014
TW 201224715 6/2012

(Continued)

OTHER PUBLICATIONS

Office Action (dated May 4, 2016) of corresponding TW Application No. 104127771, and English translation of pp. 2-3 as marked in the Office Action.

*Primary Examiner* — Thanh Tam Le
(74) *Attorney, Agent, or Firm* — Muncy, Geissler, Olds & Lowe, P.C.

(57) ABSTRACT

A plugging structure applied to an electronic device for detachably electrically connecting to a main unit is disclosed. The electronic device comprises a housing. The plugging structure comprises a cover and a circuit board. The cover plate has two transfer ports, and two transmitting ports are listed in the cover. The circuit board is disposed between the cover and the housing, and the circuit board connects to these transmitting ports.

15 Claims, 7 Drawing Sheets

(56) References Cited

U.S. PATENT DOCUMENTS

| | | | | |
|---|---|---|---|---|
| 8,430,692 | B2 * | 4/2013 | Peng | H01R 13/518 439/607.46 |
| 8,480,410 | B2 * | 7/2013 | Early | H01R 13/665 439/620.21 |
| 8,608,497 | B2 * | 12/2013 | Bychkov | G06K 13/0806 439/218 |
| 8,740,631 | B2 * | 6/2014 | Chen | H01R 12/62 439/76.1 |
| 8,753,146 | B1 * | 6/2014 | Szeremeta | G11B 19/048 439/540.1 |
| 8,758,030 | B2 * | 6/2014 | Chen | H01R 12/77 439/493 |
| 8,845,341 | B2 * | 9/2014 | Chen | H01R 12/79 439/493 |
| 8,851,905 | B2 * | 10/2014 | Soubh | H01R 13/6658 439/499 |
| 9,106,029 | B2 | 8/2015 | Ho | |
| 9,225,090 | B2 * | 12/2015 | Chen | H01R 12/79 |

FOREIGN PATENT DOCUMENTS

| | | |
|---|---|---|
| TW | M443872 | 12/2012 |
| TW | M458706 | 8/2013 |
| WO | WO2012054567 | 4/2012 |

* cited by examiner

8'

CONNECTOR HOLDER AND ELECTRONIC DEVICE WITH CONNECTOR HOLDER

BACKGROUND OF THE DISCLOSURE

1. Field of the Disclosure

The present disclosure relates to a plugging device, it relates to a plugged structure with double transmitting interface.

2. Description of the Related Art

With the development of electronic products, the interfaces for transmitting, such as USB2.0, SATA 6 Gbps and IEEE 1394, are increasing in number. One electronic device usually has one transmitting portion. Because electronic devices are becoming progressively thinner, most electronic devices do not have surplus space for additional transmitting portions.

Although the number of transmitting interfaces is increasing and new interfaces provide faster transmitting speeds, the original transmitting interface is still in demand. As shown in FIG. 1, the military electronic device 8' has a single transmitting interface. A military electronic device must be waterproof dustproof, and protected from EMI, and the volume thereof is limited. The military electronic device is plugged with whole machine. Therefore, one goal of industry is to produce a military electronic device meeting the present transmitting requirements and retaining the original transmitting interface.

SUMMARY OF THE DISCLOSURE

The problem, which the present invention solving, is providing a structure with two transmitting interface.

For solving said problem, the present invention provides a plugging structure applied to an electronic device for detachably electrically connecting to a main unit is disclosed. The electronic device comprises a housing. The plugging structure comprises a cover and a circuit board. The cover plate has two transfer ports, and two transmitting ports are listed in the cover. The circuit board is disposed between the cover and the housing, and the circuit board connects to these transmitting ports.

The present invention further provides an electronic device having a plugging structure as said above.

According to said embodiment, the plugging structure of the present is invention has at least the advantage below: Because the cover has an original transmitting interface and an additional transmitting interface, the electronic device retains the plugging structure of the original signal transmitting interface and adds a new transmitting interface in the existing space.

BRIEF DESCRIPTION OF THE DRAWINGS

The exemplary embodiment of the present disclosure will be understood more fully from the detailed description given below and from the accompanying drawings of the disclosure, which, however, should not be taken to limit the disclosure to the specific embodiment, but are for explanation and understanding only.

DETAILED DESCRIPTION OF THE PREFERRED EMBODIMENT

To facilitate understanding and to clarify; the object, characteristics, and advantages of the present disclosure, the following specific embodiments and figures illustrating the present disclosure are presented as a detailed description.

Figure 1:
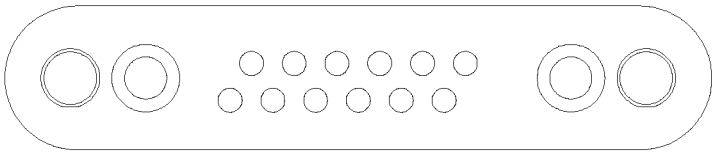
FIG.1 Prior Art
FIG. 1 illustrates the plugging structure of the prior art.
Figure 2:
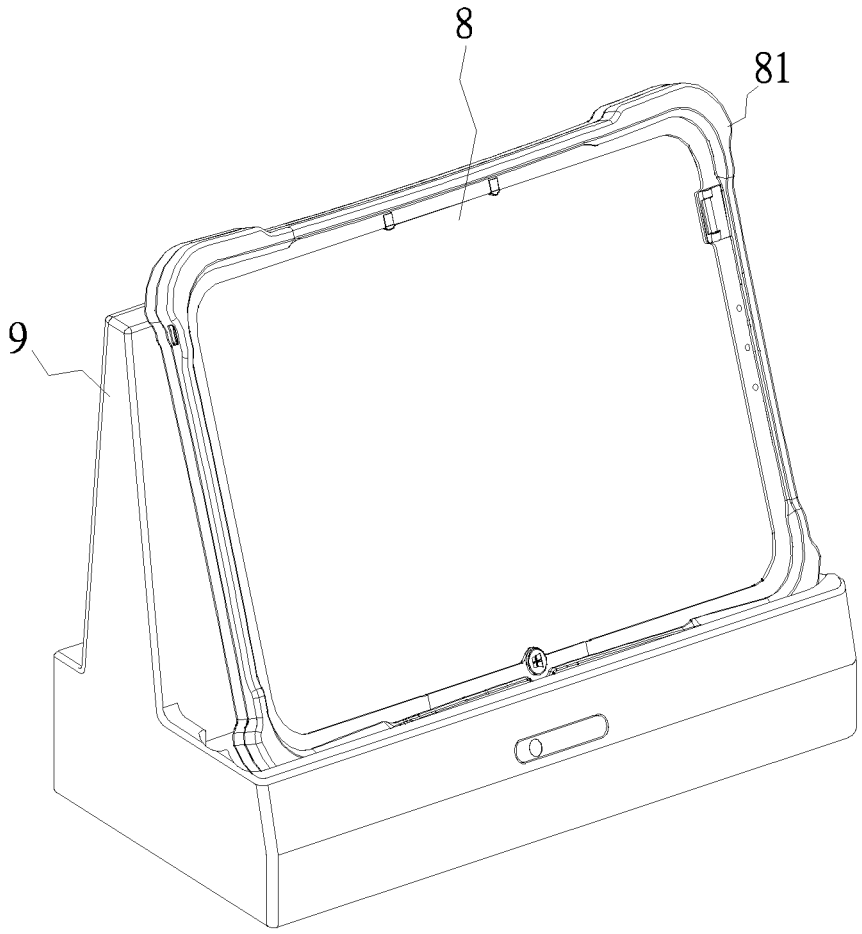
FIG. 2 illustrates the electronic device and the main body device of the present disclosure.

As shown in FIG. 2, the present invention provides a plugging structure 1 applied to an electronic device 8. The plugging structure 1 detachably electronically connects to a main body device 9, and the electronic device 8 and the main body device 9 can transmit information or an electronic charging current to each other. In one embodiment of the present invention, the electronic device 9 is a tablet computer and the main body device 9 is a computer, but the present invention is not limited to said embodiment. The electronic device of the present invention is a rugged electronic device meeting military standards of high protection from electromagnetic interference (EMI), waterproofing, and dustproofing. The electronic device 8 comprises a housing 81. Henceforth in this description, the military standard refers to a product that can be used in a rigorous or special environment or satisfy specific durability demands but is not limited to military use.

Figure 3:
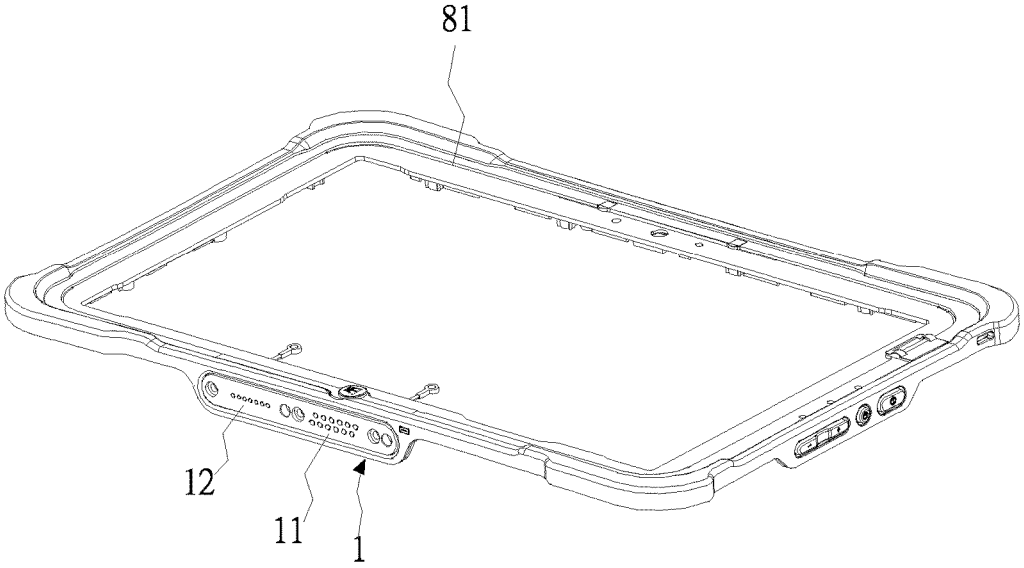
FIG. 3 illustrates a three dimensional view of the electronic device the present disclosure.
Figure 4:
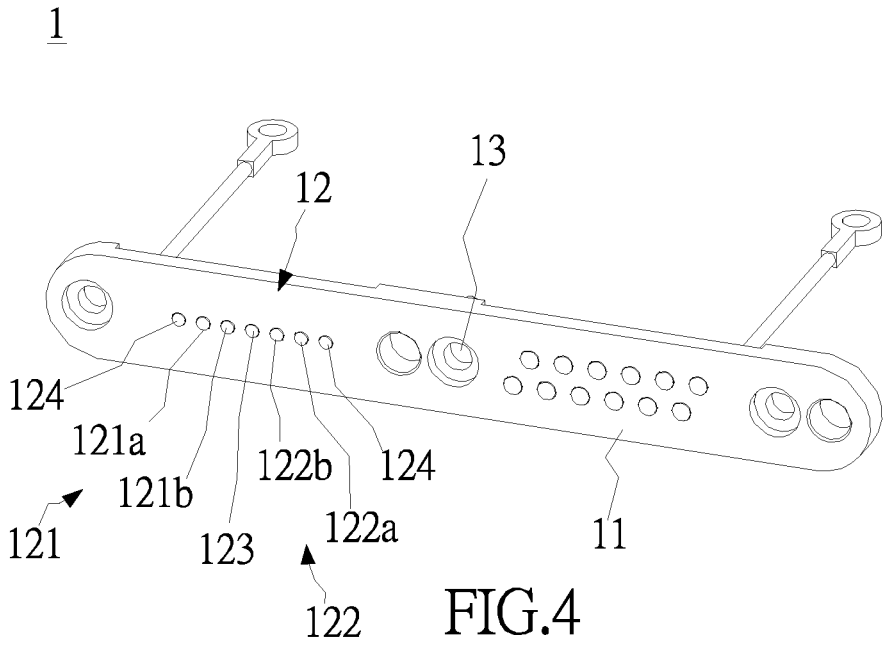
FIG. 4 illustrates a three dimensional view of the plugging structure of the present disclosure.
Figure 5:
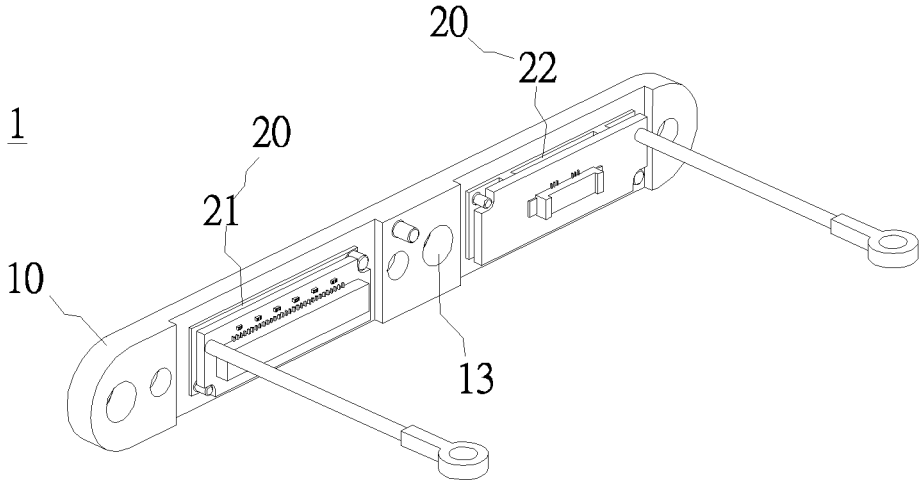
FIG. 5 illustrates a three dimensional view with other perspective of the plugging structure of the present disclosure.
Figure 6:
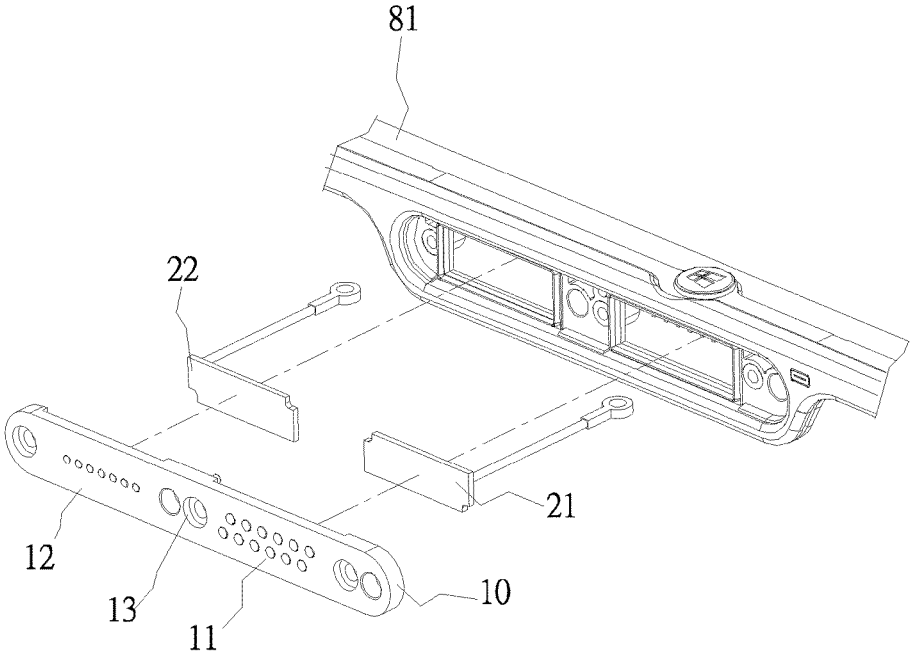
FIG. 6 illustrates an exploded view of the plugging structure of the present disclosure.

As shown in FIG. 3, FIG. 4 and FIG. 5, the plugging structure 1 comprises a cover 10 and an circuit board 20. The circuit board 20 is disposed between the cover 10 and the housing 81. The cover 10 comprises two transmitting portions, the two transmitting portions being a first transmitting portion 11 and a second transmitting portion 12. The first transmitting portion 11 and the second transmitting portion 12 are arranged side by side in the cover 10. The first transmitting portion 11 is an original transmitting interface, and the second transmitting portion 12 is an additional transmitting interface. The original transmitting interface exists in older versions of the electronic device 8, such as a USB 2.0 or an IEEE interface, and the additional transmitting interface is a USB 3.0 interface. As a result, the plugging structure 1 supports the original transmitting interface and the additional transmitting interface at the same time. The electronic device 8 retains the original interface for transmitting signal information and adds a new transmitting interface. As stated above, the difference between the electronic device 8 meeting military standards and a consumer product is the requirement of waterproofing and Jo dustproofing. Therefore, one cover 10 has a first transmitting portion 11 and a second transmitting portion 12 to reduce the chance of water or dust entering the device during the plugging or unplugging process. The user can handle the whole electronic device 8 to plug the electronic device 8 into the main body device 9.

As shown in FIG. 3, FIG. 4 and FIG. 5, the cover 10 has a fixing point 13. The fixing point 13 is disposed between the first transmitting portion 11 and the second transmitting portion 12. As a result, when the first transmitting portion 11 and the second transmitting portion 12 are plugged, the stress is diverted, which reduces the displacement of the cover 10. The circuit board comprises a first circuit board 12 and a second circuit board 22. The first circuit board 21 corresponds to the first transmitting portion 11, and the second circuit board 22 corresponds to the second transmitting portion 12.

As shown in FIG. 4, in the first embodiment of the present invention, the first transmitting portion 11 comprises a pair of transmitting contacts 121, a pair of receiving contacts 122, a first grounding contact 123 and a pair of second grounding contacts 124. The pair of transmitting contacts 121, the pair of receiving contacts 122, the first grounding contact 123 and the pair of second grounding contacts 124 are arranged in a line. The pair of transmitting contacts 121 have a transmitting positive pole 121*a*(TX+) and a transmitting negative pole 121*b*(TX−), and the pair of receiving contacts 122 have a receiving positive pole 122*a*(RX+) and a receiving negative pole 122*b*(RX−). The first grounding contact 123 is disposed between the pair of transmitting contacts 121 and the pair of receiving contacts 122. The pair of second grounding contacts 123 are disposed on the outside of the pair of transmitting contacts 121 and the pair of receiving contacts 122. In other words, the second transmitting is portion 12 is arranged in the following order: the second grounding contact 123, the transmitting positive pole 121*a*, the transmitting negative pole 121*b*, the first grounding contact, the receiving negative pole 122*b*, the receiving positive pole 122*a* and the second grounding contact 123. The contacts for grounding are disposed between the transmitting contact 121 and the receiving contact 122. The contacts for grounding conduct static electricity, so the plugging structure 1 has an anti-electrostatic effect. The contacts described above are all made from Liquid Crystal Polymer (LCP).

As shown in FIG. 4, the intervals between the transmitting positive pole 121*a*, the transmitting negative pole 121*b*, the first grounding contact 123, the receiving negative pole 122*b*, the receiving positive pole 122*a* and the second grounding contact 123 are 2.3-2.5 mm, and the optimum interval is 2.4 mm. The diameters of the contacts described above are 0.9-1.1 mm, and the optimum diameter is 1.0 mm. In one embodiment of the present invention, the transmitting contact 121, the receiving contact 122, the first grounding contact 123 and the second grounding contact are pogo pins, and the main body device 9 also comprises pogo pins.

Figure 7:
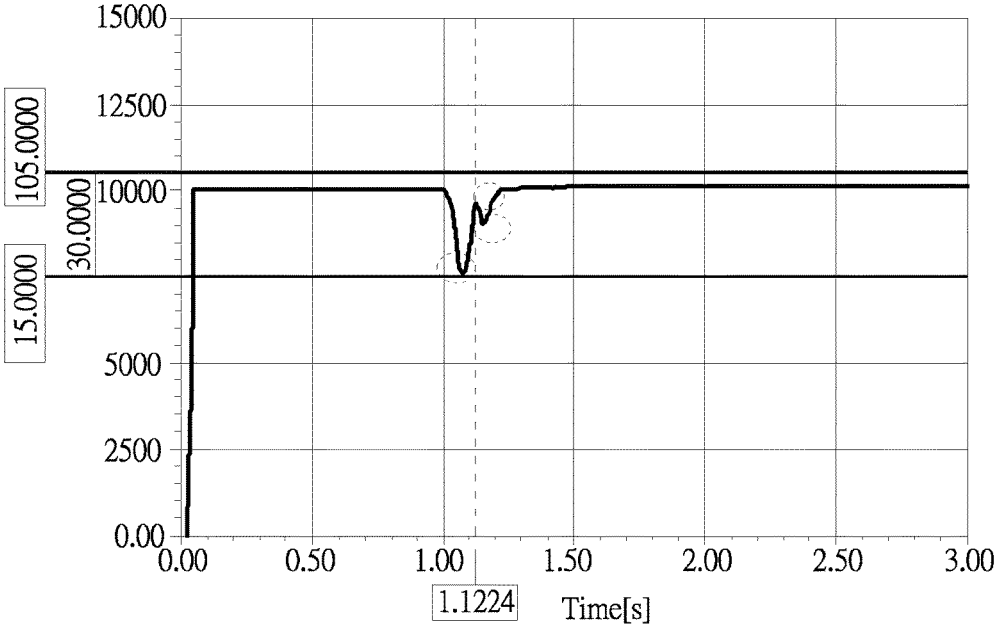
FIG. 7 illustrates an experiment diagram of the plugging structure of the present disclosure.

As shown in FIG. 7, when the interval between the transmitting contact 121 and the receiving contact 122 is 2.4 mm, the diameter thereof is 1.0 mm, and the 7.5 GHz de-emphasis current is below −27 dB, which meets the USB 3.0 Spec standard. The Spec standard is that the current before 2.5 GHz is below −27 dB, and the current M the range of 3 GHz-7.5 GHz is below −23 dB.

Figure 8:
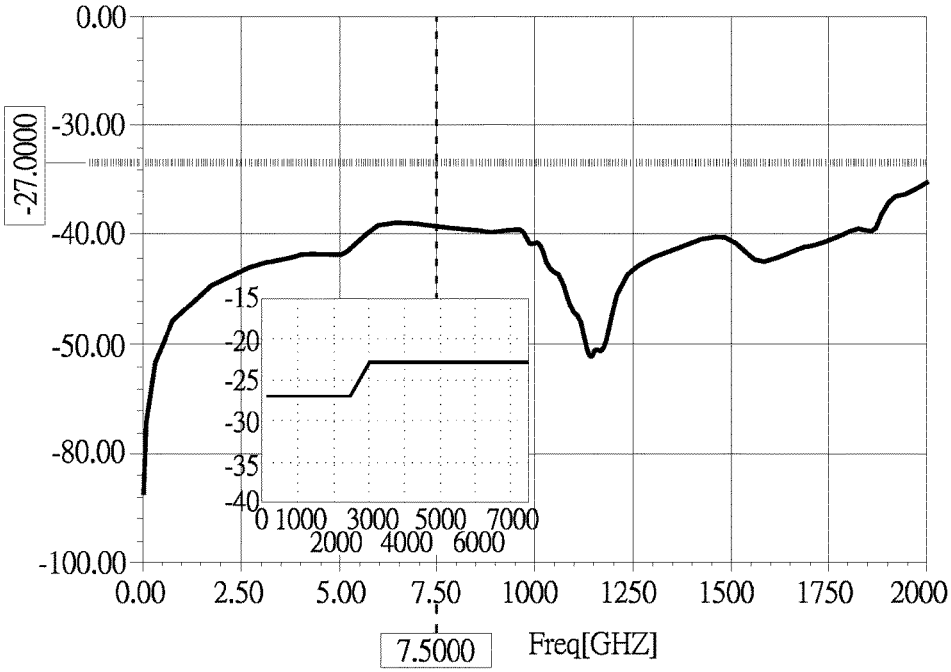
FIG. 8 illustrates an experiment diagram of the plugging structure of the present disclosure.

As shown FIG. 8, when the interval between the transmitting contact 121 and the receiving contact 122 is 2.4 mm, the diameter thereof is 1.0 mm. As taking signal, the impedance reflected to the second transmitting portion 12 is between 75 ohm 105 ohm, which meets the USB 3.0 standard.

Figure 9:
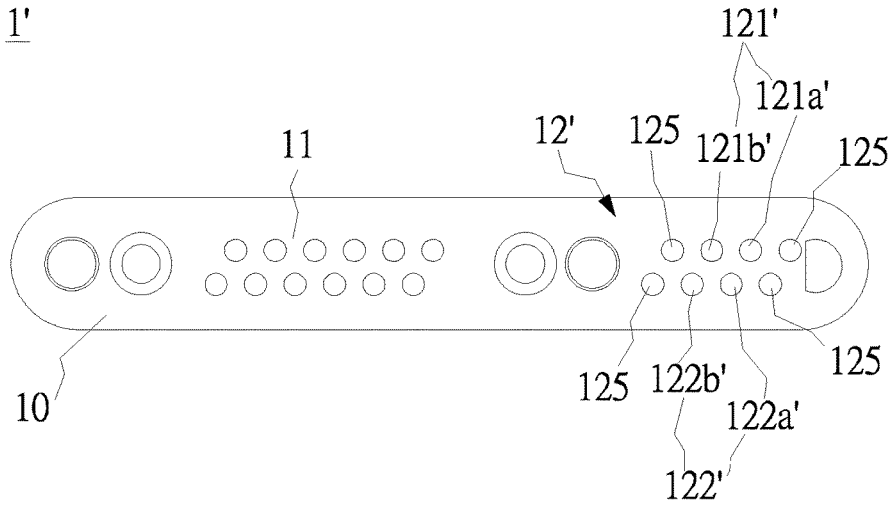
FIG. 9 illustrates an positive view of the plugging structure of the present disclosure.

As shown in FIG. 9, in a second embodiment of the present invention, the second transmitting portion 12' of the plugging structure 1' has a pair of transmitting contacts 121', a pair of receiving contacts 122' and a plurality grounding contacts 125. The contacts described above are arranged in two rows; the upper row is arranged in the order of one grounding contact 125, the transmitting negative pole 121*b*', the receiving positive pole 122*a*' and one grounding contact 125. The bottom row is arranged in the order of one grounding contact 125, the transmitting positive pole 121*a*', the receiving negative pole 122*b*' and one grounding contact 125. The upper row and the bottom row are staggered, and the intervals between the contacts belonging to the upper row and the bottom row are 2 mm. The intervals between the contacts belonging to the upper row are 3.6 mm. The intervals between the contacts in belonging to the bottom row are 3.6 mm. The diameter of any contact is 1.6 mm.

As described above, the plugging structure of the present invention has at least the advantage below: Because the cover has an original transmitting interface and an additional transmitting interface, the electronic device retains the plugging structure of the original signal transmitting interface and adds a new transmitting interface in the existing space.

It is noted that the above-mentioned embodiments are only for illustration. It is intended that the present disclosure cover modifications and variations of this disclosure provided they fall within the scope of the following claims and their equivalents. Therefore, it will be apparent to those skilled in the art that various modifications and variations can be made to the structure of the present disclosure without departing from the scope or spirit of the disclosure.

What is claimed is:

1. A plugging structure, used to an electronic device, for detachability electronic connecting to a main body device, the electronic device comprising a housing, the plugging structure comprising:

a cover with two transmitting portions disposed therein, the two transmitting portions being disposed side by side on the cover, wherein the two transmitting portions include a first transmitting portion and a second transmitting portion; and a circuit board disposed between the cover and the housing, the circuit board connecting to the two transmitting portions, wherein the circuit board comprises a first circuit board and a second circuit board, the first circuit board is corresponded to the first transmitting portion and the second circuit board is corresponded to the second transmitting portion.

2. The plugging structure as claimed in claim 1, wherein the electronic device is a rugged electronic device.

3. The plugging structure as claimed in claim 2, wherein the second transmitting portion comprising a pair of transmitting contacts, a pair of receiving contacts and a first grounding contact, the first grounding contact being disposed between the pair of transmitting contacts and the pair of receiving contacts, and the pair of transmitting contacts, the pair of receiving contacts and the first grounding contact being arranged in a line.

4. The plugging structure as claimed in claim 3, wherein the second transmitting portion further comprises a pair of second grounding contacts, the pair of second grounding contacts being disposed on the outside of the pair of transmitting contacts and the pair of receiving contacts.

5. The plugging structure as claimed in claim 4, wherein the cover has a fixing point disposed between the first transmitting portion and the second transmitting portion.

6. The plugging structure as claimed in claim 1, wherein the second transmitting portion comprises a pair of transmitting contacts, a pair of receiving contacts and a pair of grounding contacts, the pair of grounding contacts being disposed on the outside of the pair of transmitting contacts and the pair of receiving contacts.

7. The plugging structure as claimed in claim 6, wherein the pair of transmitting contacts include a transmitting positive pole and a transmitting negative pole, and the pair of receiving contacts include a receiving positive pole and a receiving negative pole, the interval between the transmitting positive pole and the transmitting negative pole being 2.3-2.5 mm, and the interval between the receiving positive pole and the receiving negative pole being 2.3-2.5 mm.

8. The plugging structure as claimed in claim 7, wherein the interval between the transmitting positive pole and the transmitting negative pole is 2.4 mm and the interval between the receiving positive pole and the receiving negative pole is 2.4 mm.

9. The plugging structure as claimed in claim 8, wherein the diameters of the pair of transmitting contacts and the pair of receiving contacts are 0.9-1.1 mm.

10. The plugging structure as claimed in claim 9, wherein the diameters of the pair of transmitting contacts and the pair of receiving contacts are 1 mm.

11. The plugging structure as claimed in claim 10, wherein the intervals between the pair of transmitting contacts, the pair of receiving contacts, the first grounding contact and the pair of second grounding contact are 3.6 mm, and the diameters of the pair of transmitting contacts, the pair of receiving contacts, the first grounding contact and the pair of second grounding contacts are 1.6 mm.

12. The plugging structure as claimed in claim 11, wherein the two transmitting portions include an additional transmitting interface, the additional transmitting interface being a USB 3.0 transmitting interface.

13. The plugging structure as claimed in claim 1, wherein the cover has a fixing point disposed between the first transmitting portion and the second transmitting portion.

14. The plugging structure as claimed in claim 1, wherein the second transmitting portion is a USB 3.0 transmitting interface.

15. The electronic device, comprising a housing and a plugging structure as claimed in claim 1, for a detachable electronic connection to a main body device.

* * * * *